US005881901A

United States Patent [19]

Hampton

[11] Patent Number: 5,881,901

[45] Date of Patent: Mar. 16, 1999

[54] REFUSE RECEPTACLE DESIGNED TO HOLD RECYCLED PLASTIC BAGS AS INNER LINERS

[76] Inventor: Richard Stockton Hampton, 1130 Kingston Dr., La Habra, Calif. 90631

[21] Appl. No.: 550,170

[22] Filed: Oct. 30, 1995

[51] Int. Cl.[6] ..... B65D 90/00

[52] U.S. Cl. ..... 220/495.08; 220/495.11; 220/771; 220/908.1

[58] Field of Search ..... 220/404, 908, 220/403, 771, 495.08, 495.11, 908.1; 206/505, 579

[56] References Cited

U.S. PATENT DOCUMENTS

| | | | |
|---|---|---|---|
| 3,825,150 | 7/1974 | Taylor . | |
| 4,664,347 | 5/1987 | Brown et al. | 220/404 X |
| 4,753,367 | 6/1988 | Miller et al. . | |
| 4,856,675 | 8/1989 | Palazzola | 220/404 |
| 4,867,339 | 9/1989 | Hahn | 220/404 |
| 4,938,380 | 7/1990 | Donahoe | 220/404 |
| 5,100,087 | 3/1992 | Ashby | 220/404 X |
| 5,160,063 | 11/1992 | Bailey . | |
| 5,235,795 | 8/1993 | DeBusk | 220/404 X |
| 5,417,338 | 5/1995 | Roy et al. | 220/404 X |

*Primary Examiner*—Steven Pollard
*Attorney, Agent, or Firm*—Robert D. Fish; Crockett & Fish

[57] ABSTRACT

A refuse receptacle designed to hold in place a recycled plastic bag as an inner liner via a molded plastic container which is specially dimensioned to securely fit a recycled plastic bag and specially designed side handles with recessed ends which, when the handles of a recycled plastic bag are hooked underneath, act to securely hold the recycled plastic bag in place as an inner liner for the receptacle.

4 Claims, 1 Drawing Sheet

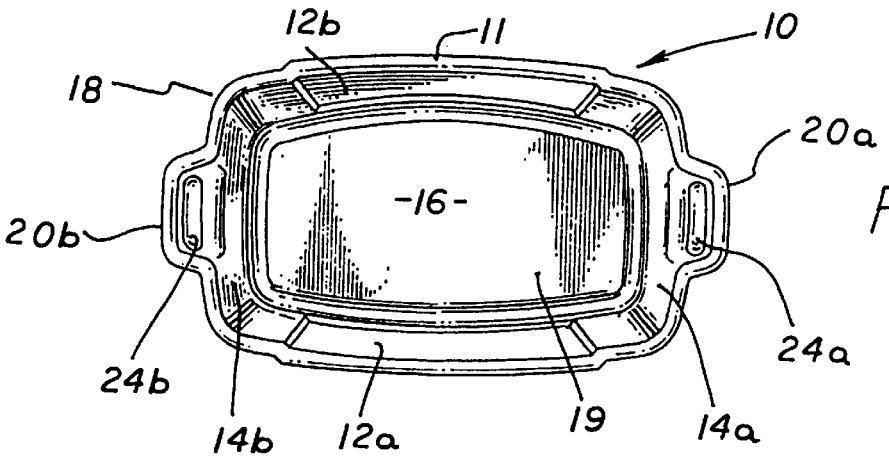
FIG. 2
FIG. 1
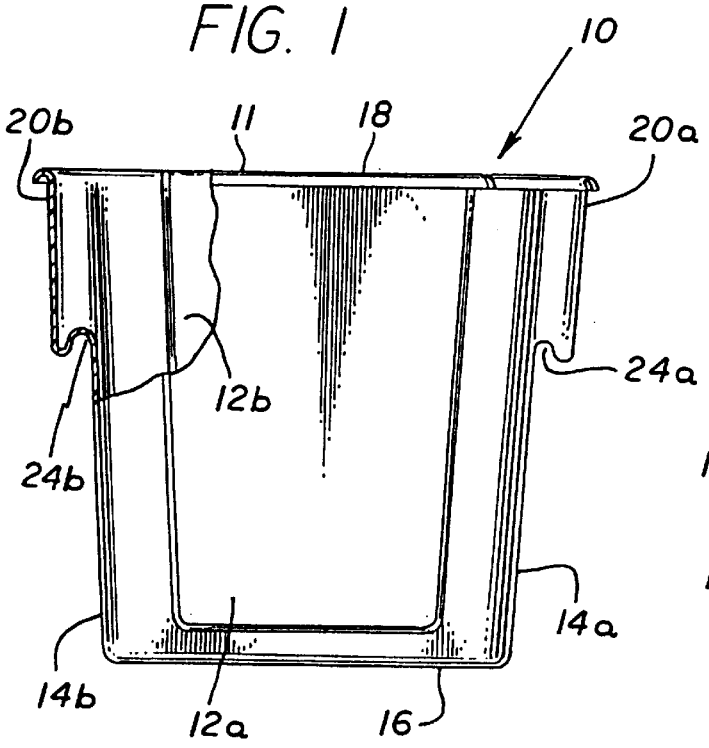
FIG. 3
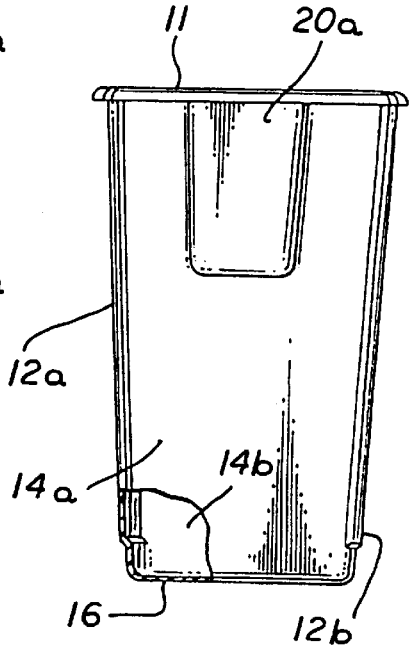
FIG. 4
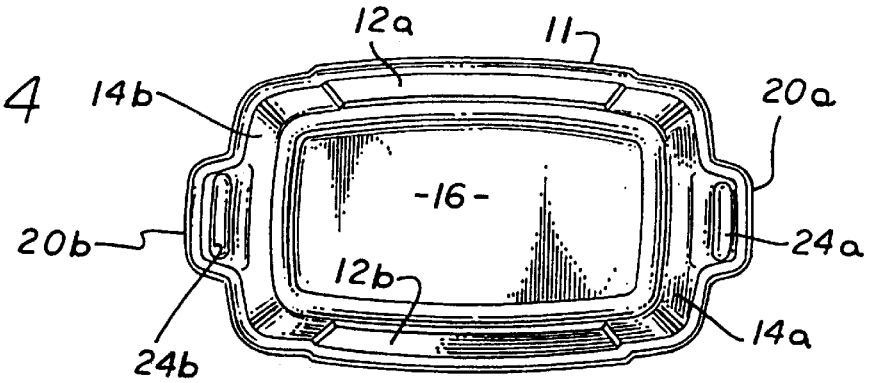

REFUSE RECEPTACLE DESIGNED TO HOLD RECYCLED PLASTIC BAGS AS INNER LINERS

BACKGROUND OF INVENTION

This invention relates to a refuse receptacle designed to hold recycled plastic bags as inner liners.

BACKGROUND DESCRIPTION OF PRIOR ART

Consumers regularly receive recycled plastic bags from grocery stores, supermarkets and other stores which sell goods These recycled plastic bags, while ranging in size, all contain handles on them which make them ideal for reuse as a garbage bag. These recycled plastic bags are typically brought home by the consumer and reused as garbage bags. Such reuse enables the consumer to eliminate the necessity of purchasing separate, costly trash bags.

Previous patents relating to refuse receptacles have not specifically addressed the use of a recycled plastic bag as an inner liner for a receptacle. Further, no previous patent has specifically addressed a proper means for securely holding a recycled plastic bag in place as an inner liner.

The typical home refuse receptacle is not designed to hold into place recycled plastic bags. As a result, in reusing recycled plastic bags as inner liners for home garbage cans or receptacles, consumers regularly meet with difficulty in securing the bags in the containers. Typically, the consumer will simply leave the recycled plastic bag sitting loosely in the interior of the receptacle. This method of reusing the bag, however, is not sound. It results in spills and messes inside the refuse receptacle.

In attempting to use a recycled plastic bag as an inner liner in the standard refuse receptacle the consumer may also try to stretch the open end of the recycled plastic bag around the open end lip of the receptacle. This, however, is not functional since the open end of recycled plastic bags are typically too small to fit around the open end of the common refuse receptacle.

Further, the consumer may attempt to hook the handles of the recycled plastic bag around the handles of the standard refuse receptacle, thereby attempting to secure the bag as an inner liner. This, however, is not functional either since the size and design of standard refuse receptacle handles are not adapted to hold the handles of a recycled plastic bag, which are generally smaller in size than the handles of the standard refuse receptacle. It is therefore clear that a problem exists which previous patents have not addressed: the use of recycled plastic bags as inner liners in refuse receptacles.

No patent has been issued which directly addresses a refuse receptacle which is designed specifically to hold a recycled plastic bag in place as an inner liner.

Various patents have been issued which address the separate issue of a refuse receptacle designed to hold into place a large trash can bag. These large trash can bags are the type purchased separately by the consumer in packs of ten, twenty and so on. In particular, U.S. Pat. No. 4,753,367 (1987), to David C. Miller and Thomas J. pendleton, addresses a wastebasket which is adapted to receive a large trash can bag as an inner liner. The wastebasket is designed to retain purchased trash can bags and not recycled plastic bags. By reference to the specification and drawings included with the Miller and pendleton patent, it is clear that the means of retaining the trash can bag as an inner liner would not be suitable to a recycled plastic bag, which is commonly smaller than a store purchased trash can bag.

Similar to the above patent is U.S. Pat. No. 3,825,150 (1972), issued to William D. Taylor. Taylor's receptacle is designed to hold into place store purchased trash can bags via resilient tabs formed into the side walls of the container. These tabs pinch the open ends of the trash can bag between the tabs and the adjacent receptacle wall, thus securing the bag as an inner liner. Like the above mentioned patent, Taylor's patent does not address the problem of holding recycled plastic bags as inner liners. The patent is designed for larger store purchased trash can bags. By reference to the patent and the drawing therein, it is clear that the system devised for holding the inner liners in place would not properly hold in place a recycled plastic bag, which is smaller in size than the average store purchased trash can bag.

U.S. Pat. No. 5,160,063 (1991), issued to Daryl K. Bailey, refers to a refuse receptacle adapted to hold a trash can bag in an open state. The trash can bag is held in place by annular structures located on the upper portions of the sidewalls of the receptacle. The annular structures grip the trash can bag and hold it in place. Again, as with the other above mentioned patents, this patent is designed to hold store purchased trash can bags, and not the recycled plastic bags which grocery stores and other stores give to consumers.

None of the above patents are designed to hold into place recycled plastic bags, which consumers receive at grocery stores, supermarkets and other stores free of charge. The above patents solely address store purchased trash can bags. Accordingly, these patents have several disadvantages:

(a) They offer no proper method to use or securely hold recycled plastic bags as inner liners. The prior patents allow only for store purchased trash can bags to be held in place as inner liners. These patents do not address the contemporary preference the consumer has for reusing recycled plastic bags as inner liners.

(b) They do not offer the economical advantages that a refuse receptacle designed to hold recycled plastic bags as inner liners offers. The standard refuse receptacle necessitates that the consumer purchase trash can bags which line the interior of the receptacle properly. A refuse receptacle designed to hold recycled plastic bags, however, eliminates the need to purchase trash can bags since it utilizes recycled plastic bags which the consumer receives free at grocery stores and other stores. The common refuse receptacle does not offer this economic advantage.

(c) They do not offer the environmental advantages which a refuse receptacle designed to reuse recycled plastic bags offers. Reusing the recycled plastic bags one receives from grocery stores and other stores is an environmentally positive act. The prior patents in this area, which require that the consumer separately purchase trash can bags, do not offer this environmental advantage.

OBJECTS AND ADVANTAGES

Accordingly, several objects and advantages of my refuse receptacle are:

(a) to provide the consumer with a refuse receptacle that is designed to securely hold recycled plastic bags as inner liners;

(b) to provide, simultaneously, the consumer with a refuse receptacle which may also utilize common store purchased trash can bags the likes of which previous inventions utilize. The receptacle thereby provides the consumer with a choice of which bags to utilize, a choice previous patents do not allow the consumer.

(c) to provide the consumer with a refuse receptacle which is economically sound. Through using a receptacle which holds recycled plastic bags as inner liners, the consumer need not purchase separate trash can bags. The receptacle, therefore, is economically advantageous to the consumer.

(d) to provide the consumer with a refuse receptacle that is environmentally advantageous. Through the use of recycled plastic bags, which would otherwise be thrown away, the receptacle provides the consumer with an environmental alternative to using separately purchased trash can bags. Previous patents in this area do not offer the user this environmental advantage.

There are no prior patents which directly solve the problem of how to securely hold a recycled plastic bag as an inner liner in a refuse receptacle. The most similar patents involve receptacles adapted to hold larger store purchased trash can bags. The disadvantage of these patents is that they do not address the issue of recycled plastic bags, which are a widely used replacement for store purchased trash can bags. My refuse receptacle provides the consumer with the means to use recycled plastic bags easily and securely via specially designed handles which hold the bag in place. Further, my refuse receptacle can still be used in conjunction with the larger store bought trash can bags. My refuse receptacle, therefore, provides the consumer with a choice of which bags to use. The prior patents in this area do not provide the consumer with such a choice of options. Further, the previous patents are disadvantaged in that they do not offer the economic and environmental advantages which my receptacle offers.

Further objects and advantages will become apparent from a consideration of the ensuing description and drawings.

BRIEF DESCRIPTION OF THE DRAWING FIGURES

The present invention will be more fully understood by reference to the following detailed description thereof when read in conjunction with the attached drawings, and wherein:

FIG. 1. shows a front view of a refuse receptacle shown partially in section. This front view is depicted as if the receptacle is sitting upright on a flat surface. The side handles are visible on both the right and left side of the receptacle.

FIG. 2. shows the top plan view of a refuse receptacle looking into the actual interior of the receptacle as it sits upright on a flat surface.

FIG. 3. shows a side view of a refuse receptacle shown partially in section. This side view is depicted as if the receptacle is sitting upright on a flat surface. One of the two side handles is visible in this view of the receptacle. This side view is an accurate and detailed depiction of either side of the receptacle, as both sides are identically the same and feature the identical side handles.

FIG. 4. is a bottom plan view of the receptacle.

REFERENCE NUMERALS IN DRAWINGS

9 Interior of Receptacle

10 Molded Receptacle (Whole)

11 Upper Rim

12*a*, 12*b* Walls, Front and Rear

14*a*, 14*b* Vertical Sidewalls

16 Closed Bottom

18 Open End

20*a*, 20*b* Side Handles

24*a*, 24*b* Recesses (Recessed Ends of Side Handles)

DETAILED DESCRIPTION OF THE DRAWINGS

FIGS. 1 to 4 in the drawings show a refuse receptacle designed to hold recycled plastic bags as inner liners. The receptacle comprises:

A molded receptacle generally described as 10 having vertical front and rear walls 12*a* and 12*b*, Also vertical side walls 14*a* and 14*b*; and An upper rim 11 defining an open end 18, Including a closed bottom 16. All form the top open end 18 of the receptacle 10.

Two side handles 20*a* and 20*b* located on each of the sidewalls 14*a* and 14*b*. FIG. 1 shows a frontal view of the receptacle in which the two side handles 20*a* and 20*b* are shown, as located, on the respective sidewalls 14*a* and 14*b*. FIG. 3 depicts a sideview of the receptacle in which one of two side handles 20*a* and 20*b* is visible. The side handles 20*a* and 20*b* are located at the top of each sidewall 14*a* and 14*b* and are designed with recesses 24*a* and 24*b* to receive the handles of a recycled plastic bag such that the bag will tightly line the interior 9 of the receptacle.

OPERATION FIGS. 1 AND 2

The manner of using the refuse receptacle to hold recycled plastic bags as inner liners is as follows:

A recycled plastic bag is first placed into the interior of the receptacle. FIG. 2 shows the interior of the receptacle. The open end of the bag is placed over the open end and open rim of the receptacle. The handles of the recycled plastic bag are then pulled over the open end lip of the receptacle and placed under the recessed end of the side handles located on the exterior of the sidewalls of the receptacle. FIG. 1 shows both side handles. Once the handles of the recycled plastic bags are hooked under the recessed ends of the side handles of the receptacle, the recycled plastic bag will line the interior of the receptacle securely.

SUMMARY, RAMIFICATIONS AND SCOPE

Accordingly, the reader will see that my refuse receptacle provides the user with a receptacle designed to hold recycled plastic bags as inner liners. These recycled plastic bags are the type given out to consumers at grocery stores and other stores free of charge. The invention provides the user with a receptacle that can fit such recycled plastic bags securely and tightly, thus alleviating any mess usually accompanying the use of such bags with standard waste receptacles. Further, the invention, while adapted specifically for such recycled plastic bags, can nonetheless be used with store purchased trash can bags. Furthermore, the receptacle has further advantages in that:

it provides the user with an economical alternative to using store purchased trash can bags. Recycled plastic bags are given out free of charge to the consumer in grocery stores and other retail stores. Through use of the present receptacle, which is designed specifically to utilize these recycled plastic bags, the costly need for store purchased trash can bags is therefore eliminated. The receptacle therefore presents clear economical advantages.

it provides the user with an environmental alternative to using store purchased trash can bags. The receptacle is designed to reuse recycled plastic bags, and it therefore encourages the use of recycled materials.

it permits the production of receptacles in a variety of colors since it is a molded receptacle.

it permits the production of receptacles of different dimensions to fit different sized recycled plastic bags and store purchased trash can bags.

Although the description above contains many specificities, these should not be construed as limiting the scope of the invention but as merely providing illustrations of some of the presently preferred embodiments of this invention.

Thus, the scope of the invention should be determined by the appended claims and their legal equivalents, rather than by the examples given.

I claim:

1. A refuse receptacle for use with a plastic bag having at least two looped handles, comprising:

a molded container having a base and a plurality of walls which collectively define a cavity with an upper opening;

a first and a second of the plurality of walls each having an upper outpocketed portion which forms a first and a second receptacle handle, respectively;

the first and second receptacle handles each defining a lower recess with a lip capable of holding in place one of the handles of the plastic bag, wherein each of the receptacle handles has an outer surface and an inner surface; and multiple copies of the refuse receptacle are stackable such that the inner surface of a lower stacked receptacle handle juxtaposes the outer surface of an upper stacked receptacle handle.

2. A refuse receptacle for use with a plastic bag having at least two looped handles, comprising:

a molded container having a base and a plurality of walls which collectively define a cavity with an upper opening;

a first and a second of the plurality of walls each having an upper outpocketed portion which forms a first and a second receptacle handle, respectively;

the first and second receptacle handles each defining a lower recess with a lip capable of holding in place one of the handles of the plastic bag, the lips of each of the first and second receptacle handles has a bottom, and the recess of each of the first and second receptacle handles has a depth which is small relative to a distance measured between the bottom of the corresponding lip and the upper opening of the receptacle;

a horizontal area of the cavity becomes progressively smaller from the upper opening to the base; and each of the receptacle handles has an outer surface and an inner surface, and multiple copies of the refuse receptacle are stackable such that the inner surface of a lower stacked receptacle handle juxtaposes the outer surface of an upper stacked receptacle handle.

3. An improved refuse receptacle adapted to receive and hold as an inner liner a recycled plastic bag having a handle, the receptacle having at least one side wall and a catch for holding the bag handle, the improvement comprising:

the catch being formed as a hollow extension of the side wall, wherein the extension has an outer surface and an inner surfaces;

a base, wherein the receptacle has an inner circumference which becomes progressively smaller from the upper opening to the base; and multiple copies of the refuse receptacle are stackable such that the inner surface of the extension of a lower stacked receptacle juxtaposes the outer surface of the extension of an upper stacked receptacle.

4. An improved refuse receptacle adapted to receive and hold as an inner liner a recycled plastic bag having a handle, the receptacle having at least one side wall and a catch for holding the bag handle, the improvement comprising the catch being formed as a hollow extension of the side wall wherein:

the extension has a substantially horizontal lower recess which is shallow compared with the size of the extension;

the refuse receptacle further comprises a base, and the receptacle has an inner circumference which becomes progressively smaller from the upper opening to the base; and wherein the extension has an outer surface and an inner surface, and multiple copies of the refuse receptacle are stackable such that the inner surface of the extension of a lower stacked receptacle juxtaposes the outer surface of the extension of an upper stacked receptacle.

* * * * *